US005735235A

United States Patent [19]

Li

[11] Patent Number: 5,735,235

[45] Date of Patent: Apr. 7, 1998

[54] METHOD AND SYSTEM FOR HEATING A LIQUID

[76] Inventor: Weicheng Li, 1810-100 Parkway Forest Dr., Willowdale, ON., Canada, M2J 1L6

[21] Appl. No.: 633,170

[22] Filed: Apr. 16, 1996

[51] Int. Cl.[6] ..... F22B 33/00

[52] U.S. Cl. ..... 122/1 R; 122/31.1; 122/31.2; 122/24; 123/545

[58] Field of Search ..... 122/1 R, 31.1, 122/31.2, 24; 110/216; 123/198 R, 198 C, 545

[56] References Cited

U.S. PATENT DOCUMENTS

| | | | |
|---|---|---|---|
| 3,760,778 | 9/1973 | May | 123/41.17 |
| 4,027,631 | 6/1977 | Lavery | 122/26 |
| 4,201,058 | 5/1980 | Vaughan | 60/618 |
| 4,426,847 | 1/1984 | Fischer | 60/514 |
| 4,429,661 | 2/1984 | McClure | 122/20 B |
| 4,479,484 | 10/1984 | Davis | 126/362 |
| 4,570,612 | 2/1986 | Ripka et al. | 122/31 A |
| 4,780,076 | 10/1988 | Davis | 122/24 |
| 4,846,148 | 7/1989 | Zifferer | 126/355 |
| 5,381,742 | 1/1995 | Linton et al. | 110/346 |
| 5,413,279 | 5/1995 | Quaas et al. | 237/12.3 C |
| 5,520,165 | 5/1996 | Khinkis et al. | 126/355 |

*Primary Examiner*—Henry A. Bennett
*Assistant Examiner*—Jiping Lu

[57] ABSTRACT

A direct contact gas-to-liquid method and system for heating a liquid with a burning source being wholly submerged and producing-power is disclosed. A liquid is heated by an internal combustion engine means, which is submerged in a container and can utilize the inherent swelling power from the burning gases in the engine means to draw large air into the engine means to support the burning without any other drift device, and to further drive other devices supplying and heating the liquid in the heating method and the heating system.

8 Claims, 1 Drawing Sheet

METHOD AND SYSTEM FOR HEATING A LIQUID

BACKGROUND OF THE INVENTION

This invention relates to a direct contact gas-to-liquid method and system for heating a liquid and, more particularly, to an burning source being wholly submerged and producing power method and system for heating a liquid which are capable of significantly improving the efficiency utilizing energy from a burning source to heat and supply a liquid.

The present invention can be used in association with a wide range of gas-to-liquid heating devices, that including many industries as well as building and homes. One of the common and well-known system is the water heating boilers.

In the prior art based on direct contact gas-to-liquid heating way, a liquid to be heated is filled in a container, a combustion chamber in where a burner unit is located was submerged in the liquid. The chamber was perforated with holes near the bottom to allow combustion gas from the burned fuel in the combustion chamber to bubble up through the liquid. The burner unit is generally used in conjunction with pressurized air which displaces the liquid out of the perforated chamber and into the liquid container. The large heat is transferred from the combustion gas bubbles directly to the liquid. The combustion gases bubbles are then exhausted at the top of the liquid container while the heated liquid flows out the outlet. In the above process the efficiency of thermal transfer is very high than non-direct gas-to-liquid heating systems, but the heating systems with the prior art have to depend on fan device to gain enough air with higher pressure than the liquid pressure on the holes of the combustion chamber for supporting the normal combustion within the chamber and sufficiently thermal transfer between the combustion gases and the liquid. Unfortunately, these fan devices, as induced drafts, vacuums or compressors etc., are now deficient and expensive in satisfying the requirement of both rate of flow and pressure. Actually, the power consumption of fan devices seriously lowered down the entire efficiency utilizing energy from burning for heating the liquid.

SUMMARY OF THE INVENTION

The present invention exceeds the thermal efficiency of the prior art system. It created an environment for effectively providing the thermal interaction of the hot combustion gases to the liquid and compelling almost all of the heat to be communicated to the liquid, especially it further utilized the inherent swelling power from burned gases to drive large air into the combustion chamber to support the combustion without any other drift device, and to drive other devices supplying and heating the liquid in the heating method and the heating system.

The liquid can be a wide range of possible liquid including water. Preferably, the liquid is non-reactive with the combustion gases. The heat source is an oxidizing fluid such as air or oxygen supporting the burning of a combustible fluid such as a gas, typically natural gas, a synthetic gas or the like, or a combustible liquid such as oil or the like. The construction of the present invention can use material known and used in the prior art.

In one embodiment, the invention relates to a method for heating a liquid in a container comprising the steps of:

supplying a combustible fluid and an oxidizing fluid to be drawn through a valve outlet means which prevents backflow of the fluids into an internal combustion engine means wholly surrounded a liquid to be heated within a container;

burning the mixture of the combustible fluid and oxidizing fluid within the engine means to make the operation of the engine means, the burning producing hot gases, heat and machine power within the engine means;

drawing simultaneously enough the combustible fluid and oxidizing fluid into the engine means depend on the machine power from the burning in the engine means to support the burning therein without any other draft device that add energy consumption;

driving the hot gases from some lower positions than said engine means into the liquid depend on the machine power from the burning in the engine means to form a lot of the bubbles up through the liquid within the container;

driving some mechanical device working in the heating process, such as a pump means exporting the heated liquid depend on the machine power from the burning in the engine means to save the energy consumption of said mechanical device working in the heating process;

driving a generator means producing electrical power depend on the machine power from the burning in the engine means, one part of the electrical power being used to run some electrical devices such as a ignition means and an electrical motor starting the engine means to save the energy consumption of the electrical devices working in the heating process, and other part of the electrical power being used to heat the liquid by an electric heater means;

Hereby, one part of the heat from the burning in the engine means is conducted to the liquid through the partial wall of the engine means, and other part of the heat is carried by the hot gases into the liquid within the container to make the thermal transfer between the hot gases and the liquid. Obviously, there is huge thermal transfer area and little thermal resistance between the hot gases and the liquid, so that the efficiency of the thermal transfer from the burning to the liquid within the container is very excellent.

Moreover, one part of the machine power from the burning in the engine means is used to draw the combustible fluid and oxidizing fluid into the engine means for supporting the operation of the engine means and to run some devises working in the heating process to save more the energy consumption in the heating process, and other part of the machine power is changed into heat heating the liquid, so that the efficiency utilizing energy from the burning for heating and supplying the liquid is greatly enhanced.

When burning, the burning within the engine means effects a pressure to inhibit the flow of the liquid from the container into the engine means, when no burning, the valve outlet means turn off so that the engine means has not any other openings except the positions passed by the hot gases, therefore the hot gases are entrapped in the engine means to inhibit the flow of the liquid into the engine means.

In another embodiment, the invention relates to a system for heating a liquid comprising:

a container suitable for retaining some liquid at least to a predetermined level;

an internal combustion engine means located within said container so that all outer region of the engine means is in contact with the liquid, said internal combustion engine means being provided with the structure of conventional reciprocating engine and operating normally according to the working way of conventional reciprocating engine;

an input means with a valve outlet means which prevents backflow of the fluids connected with the engine means operable to mix the combustible fluid and oxidizing fluid into a combustible mixture fluid being drawn by the engine means into itself;

a releasing bubble means being at a lower portion than the engine means comprising a plurality of openings positioned to communicate with the liquid communicating with the engine means within the container to enable the flowing passage of the hot gases exhausted from the cylinder means to the openings of the releasing bubble means to form lot of bubbles as many as possible within the liquid;

a liquid inlet means located at the top of the container used to import the liquid into the container;

a liquid outlet means located at the top of the container used to export the liquid out from the container;

a chimney means also located at the top of the container used to remove the gases out from the container and thereby reduce the pressure increase which might arise in the container;

a drain means provided at the bottom of the container for draining the liquid.

Whereby the mixture of the combustible fluid and oxidizing fluid drawn through the input means with a valve outlet means into the engine means is burnt therein to make the operation of the engine means. The burning produces hot gases, heat and machine power within the engine means. The machine power from the burning in the engine means drives the hot gases into the releasing bubble means, forwards compels the hot gases to pass the openings of the releasing bubble means to form a lot of the bubbles, the bubbles then rise up through the liquid to collect above the liquid and finally are removed out the container by the chimney means.

Hereby, one part of the heat from the burning in the engine means is conducted to the liquid through the partial wall of the engine means, and other part of the heat is carried by the hot gases into the liquid within the container to make the thermal transfer between the hot gases and the liquid. Obviously, there is huge thermal transfer area and little thermal resistance between the hot gases and the liquid, so that the efficiency of the thermal transfer from the burning to the liquid within the container is very excellent.

Simultaneously, the machine power from the burning in the engine means is used to draw repeatedly the enough combustible fluid and oxidizing fluid into the engine means to support the burning therein without any other draft device that add energy consumption, so that the efficiency utilizing energy from the burning for heating the liquid is further optimized.

Because the engine means and the releasing bubble means entirely submerged in the liquid, the liquid pressure on the a plurality of openings of the releasing bubble means tends to move the liquid from the container through the releasing bubble means into the engine means. For inhibiting such movement of the liquid, when heating system is operating the burning within the engine means effect a high pressure to inhibit the flow of liquid from the container through the plurality of openings of the releasing bubble means into the engine means; when the heating system does not operate the valve outlet means of the input means turn off so that the engine means has not any other openings except communicating with the openings of the releasing bubble means which is below the engine means, thus the hot gases are entrapped in the engine means to inhibit the flow of liquid into the engine means.

As the internal combustion engine means has the large-flow and high-pressure ability to exhaust the hot gases, the container can be higher so that the depth of the liquid within the container is as deep as necessary, in order to lengthen the thermal transfer path along which the hot gases through up the liquid; and the openings of the releasing bubble means is as many and small as possible, in order to produce the bubbles as large as possible through up the liquid within the container. Thereby, to further enhance the efficiency of the thermal transfer between the hot gases and the liquid.

Other embodiments, features and advantages of the invention will become apparent upon reading the specification.

For a fuller understanding of the nature and objects of the invention, reference should be had to the following detailed description, taken in connection with the accompanying drawing in which.

The FIGURE is a structure schematic diagram of the heating system of a liquid according to the invention.

DETAILED DESCRIPTION OF THE PREFERRED EMBODIMENT

Figure 1:
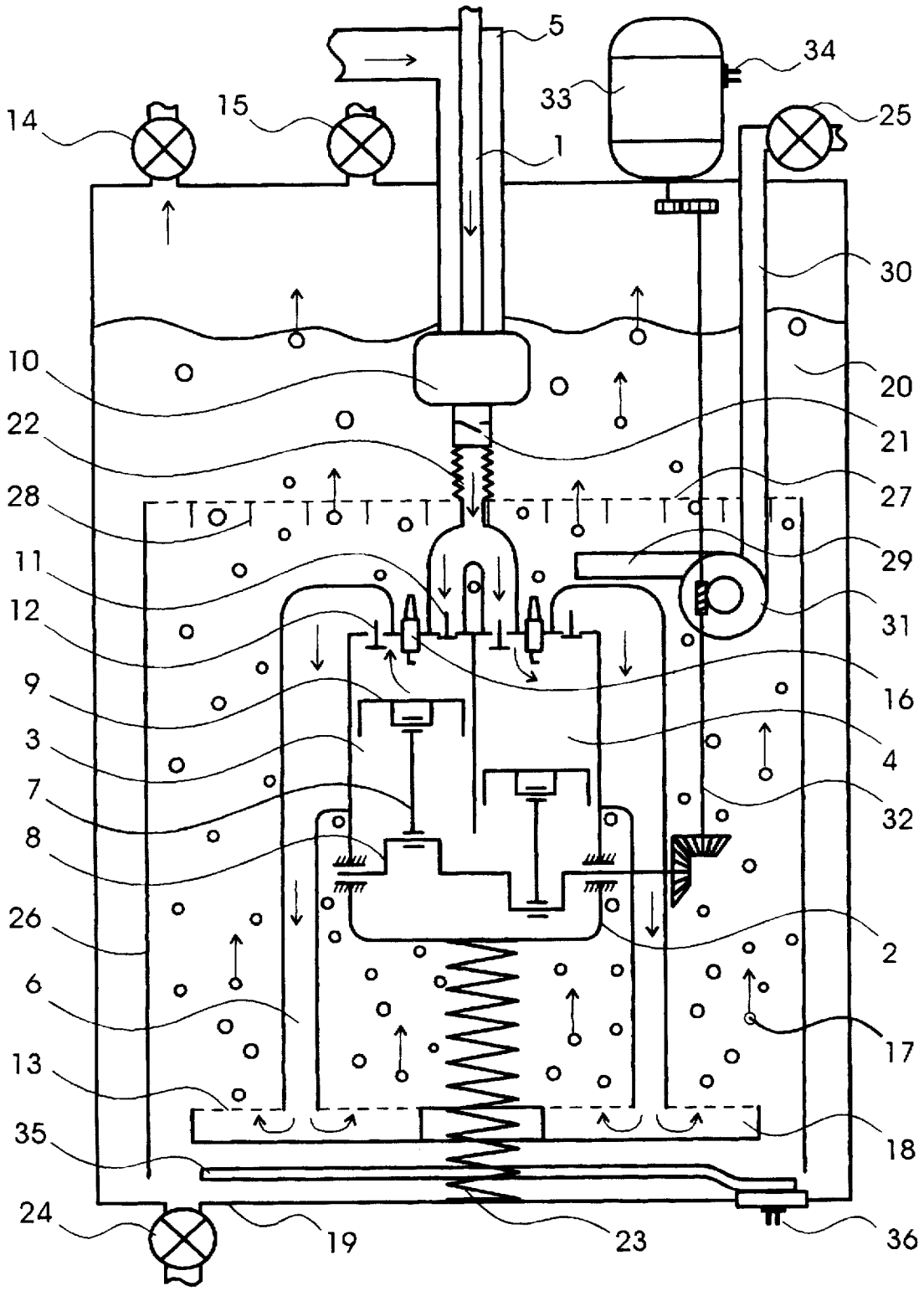

The sole FIGURE 1 shows a preferred embodiment. The diagram omits most assist mechanical structure so that the working principle of the present invention can be illustrated more clearly.

In the FIG. 1 the arrows express the way of gases moving.

The container 19 on which external surfaces attached a insulating-thermal material layer is made of a typical metal for containing a liquid such as water 20 at least to a predetermined level. Additional water 20 is imported through inlet 15 at the top of the container 19. Heated water 20 is exported through outlet 25 at the top of the container 19. The drain 24 is provided at the bottom of the container 19 for draining the water 20.

The internal combustion engine means 2 is positioned within the container 19 by a shock absorber means 23 and is wholly surrounded by water 20. The engine means 2 comprises of the cylinder means 3 and the cylinder means 4 which structures are same and are equipped same parts, such as the cylinder means 3 being equipped the intake valve means 11 and the exhaust valve means 12 and the spark plug 16 and the piston 9 and the connecting rod 7; exhaust manifold means 6 exhausting hot gases from the exhaust valve means 12; the crankshaft means 8 linked with all the pistons by the connecting rods.

The spark plug 16 is electrically connected to electrical power supply not shown in FIG. 1 so that the spark plugs 16 can ignite the gas and air mixture within the cylinder means 3 when it is activated.

The input means 10 with a valve outlet means 21 which prevents backflow of the fluids connected with the intakes of the cylinder means 3 and 4 through a pliable pipe 22 for absorbing shock. A combustible fluid such as natural gas is supplied from a source not shown in FIG. 1 to inlet pipe 1 of the input means 10. An oxidizing fluid such as air is also supplied to inlet pipe 5 of the input means 10. The input means 10 mixes them into the mixture and conduct the mixture into the cylinder means 3 and 4 by their intake means.

The releasing bubble means 18 is a circular-plate chamber at which center there is a round cave allowing the water 20 to flow and the shock absorber means 23 to stretch by there. The releasing bubble means 18 connects with exhaust manifold means 6 at a lower portion than the engine means 2. The releasing bubble means 18 has a plurality of openings 13 designed to produce as many bubbles as possible on a horizontal way at the lower position within the container 19. The hot gases leave the cylinder means 3 and 4 under pressure to travel by the exhaust manifold means 6 into the releasing bubble means 18, and through the openings 13 into the water 20 to form a lot of the bubbles 17 as many as possible.

The quarantine means 26 with the mesh cover 27 which holes are bigger than the openings of the releasing bubble means 18 made of the insulating-thermal material covers the engine means 2 and the releasing bubble means 18 within the container 19. The vertical partitions 28 is attached under the mesh cover 27 to make sure that the bubbles 17 are distributed more evenly under the mesh cover 27.

The inlet 29 of the water pump means 31 is located near the mesh cover 27 within the quarantine means 26, and the out pipe 30 of the water pump means 31 communicates with the outlet 25 at the top of the container 19 to export the heated water 20 out of the container 19.

The transmission means 32 transmitting the power from the crankshaft 8 of the engine means 2 to the water pump means 31 to drive it working.

The chimney means 14 also located at the top of the container 19 is used to remove gases and thereby reduce the pressure increase which might arise in the container 19.

The electrical heat means 35 with input plug 36 positioned at the bottom of the container 19 changes electricity energy into thermal energy to heat the water 20.

The generator 34 with the output plug 34 positioned at the top of the container 19 is driven by the machine power from the burning in the engine means 2 through the crankshaft 8 and the transmission means 32 to produce electrical power supplied to some electrical devices of the heating system such as the spark plug 16 and the electrical heat means 35.

The engine means 2 with two cylinder means normally operates according to the working method of conventional reciprocating engine, therefore the professional skilled explanation of its work detail is omitted here. In the FIG. 1 the condition shown within the engine means 2 only display the functions of the parts, but does not display that the parts exactly match each other in the working sequence therein.

Whereby, as the piston 9 moves down the combustible fluid and the oxidizing fluid are drawn through the input means 10 into cylinder means 3 only which intake valve 11 means is opening this moment. When the piston 9 moves up at the top the spark plug 16 ignites the combustible mixture to lead the twinkling burning, that is just explosion, so that produces hot gases, heat and machine power within the cylinder means 3.

The machine power from the burning in the cylinder means 3 puts the piston 9 to move down so turning the crankshaft means 8 by the connecting rod 7, while another piston of the cylinder means 4 is drive to draw enough the combustible fluid and the oxidizing fluid into the cylinder means 4 to support the operation therein. As the piston 9 moves up again depend on the inertia and acting of another piston of the cylinder means 4, the hot gases is compelled out the cylinder means 3 through the opened exhaust valve means 12. Similarly and alternately, the above working process is repeated in the cylinder means 4.

The hot gases from the exhaust valve means of the cylinder means 3 and 4 flow forwards into the releasing bubble means 18 by exhaust manifold means 6 and another, and pass the openings 13 of the releasing bubble means 18 to form a lot of the bubbles 17 up through the water 20 in the quarantine means 26. The bubbles 17 rise to pass the holes of mesh cover 27 of the quarantine means 26, then through up the water 20 above the quarantine means 26. Over a period of time, the bubbles 17 will reach the surface of the water 20 and collect at the top of the container 19. The chimney means 14 allows the removal of the cooled gases so that the pressure in the container 19 does not increase greater than a predetermined level.

Hereby, one part of the heat from the burning in the engine means 2 is conducted to the water 20 through the partial wall of the engine means 2, and other part of the heat is carried by the hot gases into the water 20 within the container 19 to make the thermal transfer between the bubbles 17 and the water 20. Obviously, there is huge thermal transfer area and little thermal resistance between the bubbles 17 and the water 20, so the efficiency of the thermal transfer from the bubbles 17 to the water 20 is very excellent. Moreover, the engine means 2 has the large-flow and high-pressure ability to overcome the pressure from the water 20 and the prevention from the openings 13 to exhaust the hot gases, so the path of the thermal transfer can be sufficient long and the bubbles 17 can be sufficient smaller and more, thereby the efficiency of the thermal transfer from the bubbles 17 to the water 20 is remarkably optimized.

In the meanwhile, the colder water 20 entered into the container 19 from water inlet 15 at top the of the container 19 is first heating by bubbles 17 above the mesh cover 27, most water 20 then drops down to the bottom of the container 19 along the path between the quarantine means 26 and the container 19, and enters the quarantine means 26 from there so that the water 20 is mainly heated by the bubbles 17 with higher temperature within the quarantine means 26. Thus, the quarantine means 26 obstruct the thermal transfer of the water 20 between the inside and the outside of quarantine means 26, so that the difference of temperature between the bubbles 17 left from water 20 and water 20 exported by pump means 31 is actually added, so that the efficiency of the thermal transfer from the bubbles 17 to the water 20 within the container 19 is further increased.

The machine power from the burning in the engine means 2 through the crankshaft means 8 and the transmission means 32 is used to drive some mechanical devices working in the heating system, such as the water pump means 31 exporting the heated water 20 out from the container 19 to save the energy consumption of the mechanical devices of the heating system;

Moreover, the machine power from the burning in the engine means 2 through the crankshaft means 8 and the transmission means 32 is used to drive the generator means 33 with the output plug 34 producing electrical power. One part of the electrical power is used to run some electrical devices such as the spark plug 16 and an electrical motor not shown in the FIG. 1 starting the engine means 2 to save the energy consumption of the electrical devices of the heating system, and other part of the electricity is conducted from the output plug 34 of the generator means 33 through a wire that is not shown in FIG. 1 and the input plug 36 of the electrical heater 35 to the electrical heater 35 for heating the water 20.

Hereby, one part of the machine power from the burning in the engine means 2 is used to draw the combustible fluid and oxidizing fluid into the engine means 2 and to run some mechanical devises such as pump means 31 and electrical devises such as the spark plug 16 and the electrical motor working in the heating system, and other part of the machine power is changed by the electrical heater 35 into heat heating the water 20, so that the efficiency utilizing energy from the burning for heating and supplying heated water 20 is greatly enhanced.

Because the engine means 2 and the releasing bubble means 18 entirely submerged in the water 20, the water pressure on the openings 13 of the releasing bubble means 18 tends to move the water 20 from the container 19 through the releasing bubble means 18 into the cylinder means 3 and 4. For inhibiting such movement of the water 20, when heating system is operating the burning within the cylinder means 3 and 4 effect a high pressure to inhibit the flow of the water 20 from the container 19 through the openings 13 of the releasing bubble means 18 into the engine means 2; when the heating system does not operate the valve outlet means 21 of the input means 10 turn off, so that the engine means 2 has not any other openings except communicating with the openings 13 of the releasing bubble means 18 which is below the engine means 2, therefore the hot gases are entrapped in the engine means 2 to inhibit the flow of the water 20 into there.

There has been described a novel method and system for heating a liquid. It is evident that those skilled in the art may now make numerous uses and modifications of and departures from the specific embodiments described herein without departing from the inventive concepts. Consequently, the invention is to be construed as embracing each and every feature and novel combination of features presented or possessed by the system and method described herein and limited solely by the spirit and scope of the appended claims.

What is claimed is:

1. A process for heating a liquid in a container comprising the steps of:

submerging an internal combustion engine means in said container so that said engine means is wholly surrounded by said liquid to be heated within said container;

drawing a combustible fluid and an oxidizing fluid into said engine means through a valve outlet means;

operating said engine means by burning a mixture of said combustible fluid and oxidizing fluid within said engine means;

producing hot gases, heat and mechanical power within said engine means;

pressing said hot gases through openings below said engine means into said liquid to form gas bubbles;

mixing said gas bubbles with said liquid for heating said liquid by direct thermal transfer;

converting said mechanical power produced by said engine means for driving other mechanical components working in said heating process;

closing said valve outlet means and maintaining a high pressure in said engine means so that any residual of said hot gases are entrapped in said engine means to inhibit flow of liquid from said container into said engine means when said engine means is in inoperative condition.

2. The process for heating a liquid as claimed in claim 1, wherein said step of converting said mechanical power produced by said engine means for driving other mechanical components working in said heating process further including driving a water pump means circulating said heated liquid from said container in said heating process.

3. The process for heating a liquid as claimed in claim 1, wherein said step of converting said mechanical power produced by said engine means for driving other mechanical components working in said heating process including driving a generator means for producing electrical power to energize an ignition means and an electrical motor for starting said engine means and an electric heater means for heating said liquid.

4. The process for heating a liquid as claimed in claim 1, wherein said step of drawing a combustible fluid and an oxidizing fluid into said engine means through said valve outlet means being responsive to demand of said mechanical power from said burning in said engine means.

5. The process for heating a liquid as claimed in claim 1, wherein said step of pressing said hot gases from said openings below said engine means into said liquid to form said gas bubbles including providing a predetermined number of openings in predetermined sizes whereby the number and sizes of gas bubbles can be controlled.

6. The process for heating a liquid as claimed in claim 5, wherein said step of forming said gas bubbles through said liquid to perform the thermal transfer between said hot gases and said liquid including increasing the depth of said liquid as necessary in order to lengthen the thermal transfer path along which said hot gases through up said liquid.

7. The process for heating a liquid as claimed in claim 1, wherein said step of submerging said internal combustion engine means in said container including holding said internal combustion engine means within said container by a shock absorber means for reducing the working shock and noises during heating.

8. The process for heating a liquid as claimed in claim 1, wherein said step of submerging said internal combustion engine means in said container including attaching an insulating-thermal material layer on the external surfaces of said container for reducing heat lost from said container.

* * * * *